United States Patent [19]

Jörss

[11] Patent Number: 4,508,330

[45] Date of Patent: Apr. 2, 1985

[54] PICK-UP AND TRANSFER MECHANISM FOR LABELS OR THE LIKE

[75] Inventor: Norbert Jörss, Neutraubling, Fed. Rep. of Germany

[73] Assignee: Pirzer Co., Neutraubling, Fed. Rep. of Germany

[21] Appl. No.: 470,340

[22] Filed: Feb. 25, 1983

[30] Foreign Application Priority Data

Feb. 25, 1982 [DE] Fed. Rep. of Germany ..... 3206704

[51] Int. Cl.[3] ..... B65C 9/12; B65C 9/16

[52] U.S. Cl. ..... 271/33; 118/231; 118/240; 118/244; 156/568; 156/571; 156/DIG. 30; 156/DIG. 32; 271/30.2; 271/95

[58] Field of Search ..... 156/568, 571, 567, 578, 156/DIG. 30, DIG. 32; 118/220, 231, 236, 240; 271/10, 18, 30 A, 33, 95, 109, 115

[56] References Cited

U.S. PATENT DOCUMENTS

| | | | |
|---|---|---|---|
| 4,077,621 | 3/1978 | Knuppertz et al. | 156/571 |
| 4,190,244 | 2/1980 | Risi | 156/568 |
| 4,323,029 | 4/1982 | Knuppertz et al. | 156/571 |

FOREIGN PATENT DOCUMENTS

| | | |
|---|---|---|
| 1936839 | 4/1971 | Fed. Rep. of Germany . |
| 2805968 | 8/1978 | Fed. Rep. of Germany . |
| 2218760 | 9/1974 | France . |

*Primary Examiner*—Michael Wityshyn
*Attorney, Agent, or Firm*—Fred Wiviott

[57] ABSTRACT

A pick-up and transfer mechanism for labels or the like, preferably for transferring labels in a labeling machine from a label magazine to a greater cylinder. The mechanism has at least one pick-up element on a carrying element rotating around a vertical axis. In order to obtain the required way of movement of the pick-up element relative to the rotating carrying element, the pick-up element is rotatably mounted on an intermediate carrier which in turn is rotatably mounted on the carrying element, with the axis of rotation of the pick-up element on the intermediate carrier being eccentrically arranged to the axis of rotation of the intermediate carrier on the carrying element and with the axis of rotation of the intermediate carrier on the carrying element being eccentrically arranged to the axis of rotation of the carrying element. The mechanism has further first cam follower means formed by a first roller engaging a first stationary control cam for pivoting the intermediate carrier and second cam follower means including a lever mechanism and being formed by a second and third roller engaging a second stationary control cam.

19 Claims, 2 Drawing Figures

PICK-UP AND TRANSFER MECHANISM FOR LABELS OR THE LIKE

Figure 1:
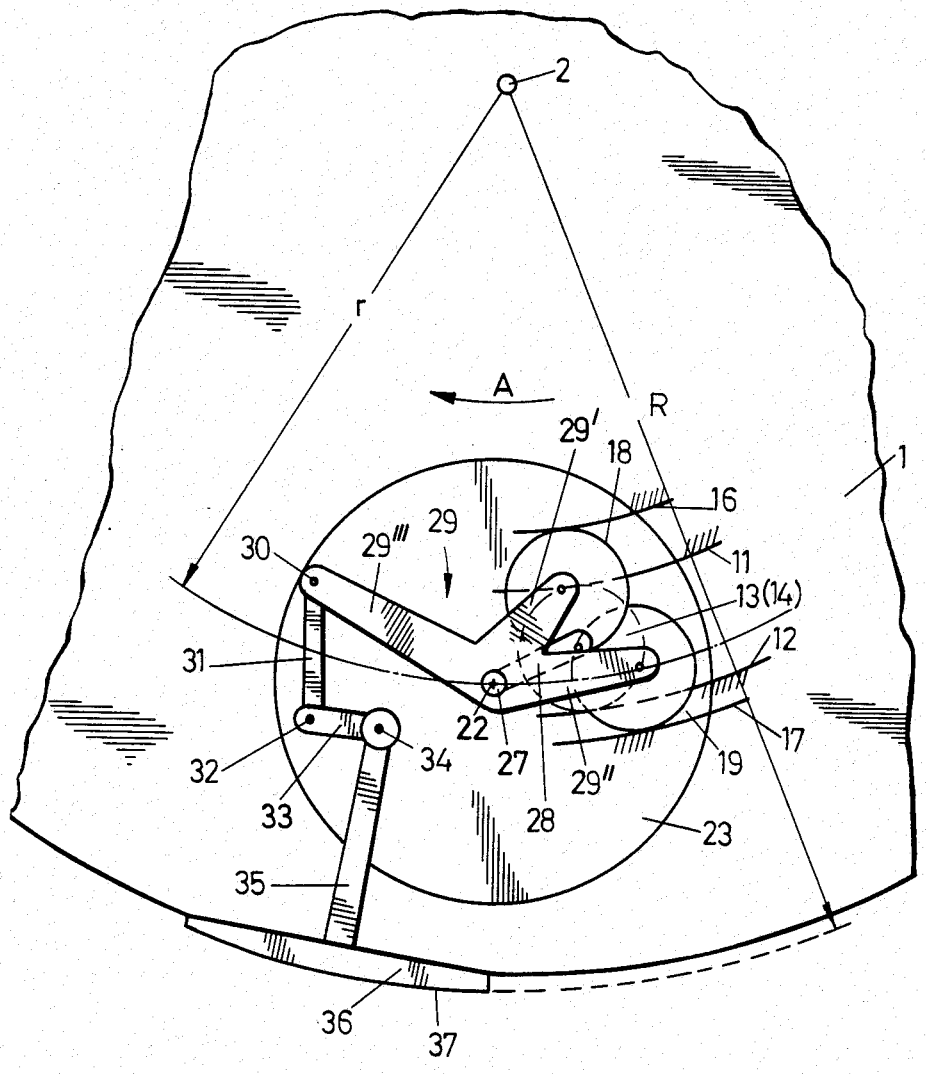

The invention relates to a pick-up and transfer mechanism for labels or the like; with at least one pick-up component, which is mounted on a first axle so that it can pivot by means of an intermediate carrier, which in turn is pivotably mounted by means of a carrying component of a second axle. This second axle is opposite the first off-set axle. The carrying component on the second axle runs around a third off-set axle which is on a machine base opposite the first and second axle, with at least one first guide element on a lever arm of the intermediate carrier, which guide element works in conjunction with a first control cam on the machine base, and with a lever element which is attached to the second axle by means of an intermediate carrier so that it can pivot, with at least one seocond guide element on the lever element which works in conjunction with a second control cam on the machine base, as well as with an intermediate lever, of which one end is linked to the lever element and the other end to a lever arm of the pick-up component, whereby one of the two guide elements is formed by a first roller and the other guide element by a pair of rollers, which consists of a second and third roller, the second roller of which lies against an inner guide surface, i.e. the guide surface of the second control cam which is closer to the third axle or the third roller of which lies against the outer guide surface of the second control cam, i.e. the guide surface which is farther removed from third axle.

A pick-up and transfer mechanism of this sort as such is known and serves e.g. in a labeling station of a container or bottle labeling machine to transfer labels one at a time from a label magazine to a so-called "gripper cylinder" which then transfers the labels to containers or bottles which are fed up to that point ready to accept labels.

The pick-up and transfer mechanism has preferably several, in each case intermediate carriers having one pick-up element, which are pivotably attached to a carrying component at a certain sectional distance. Each pick-up element of the pick-up and transfer mechanism has a surface, which moves passed a glue mechanism e.g. a glue roller to accept a film of glue, as the carrying component rotates around a third axle. This surface is then moved passed the label magazine, in which a label supply is in the form of a stack of labels, where it picks up a label with the glue film, which label is then transferred to the gripper cylinder as the carrying component continues to rotate.

If the radius of the curvature of the pick-up element (label pallet) which has received a glue film on the gripping surface which carries the labels is equal to the radius of the path of travel of this surface around the third axle, then the glue roller as well as the gripper cylinder cam roll against this surface, so that there is no additional motion of the pick-up element necessary relative to the carrying component when applying glue and transferring the labels to the gripper cylinder. The relations are different when picking up labels from the label magazine. There are gripping surfaces or the pick-up element must execute a pivoting motion relative to the carrying component around two axes which lie parallel to a third axis in order to warrant a satisfactory label pick-up from the label magazine. This pivoting motion of the pick-up element or the gripping surface relative to the carrying component is achieved by the fact that each pick-up element is pivotably mounted on a first axle on the appropriate intermediate carrier, which in turn is pivotably mounted to a second axle on the carrying component opposite the first off-set axle, whereby the pivoting of the intermediate carrier relative to the carrying component as well as the pivoting of the pick-up element relative to the intermediate carrier is achieved by a lever or drive arrangement with two continuous guide cams which surrounds the third axle on the machine base and by guide elements in the form of rollers or guide rollers which work in conjunction with the guide cams. The guide element adjoined to the one control cam operates e.g. via a lever arm directly on the intermediate carrier, while the guide element adjoined to the other control cam operates on a lever element which is pivotably mounted on the second axle. The latter lever element is linked to the appropriate pick-up element with a lever arm e.g. via an intermediate lever. It is understood that for each pick-up element or for each intermediate carrier special guide elements are designed that work in conjunction with the guide cams.

In order to keep the space above the carrying component or the pick-up element or elements free it is necessary to mount the guide cams below the pick-up element or elements or the carrying component and preferably in several planes above each other whereby not only the total of control cams, but also both lateral guide surfaces of each control cam against which guide surfaces the guide elements or guide rollers are, can be arranged in different planes. This way an extremely space saving and compact configuration is possible.

It is the task of the invention to design a pick-up and transfer mechanism as described in the beginning relative to its pivoting motion of the pick-up element and of the intermediate carrier and relative to the drive or lever arrangement in such a fashion that with the most compact construction possible a quiet and smooth running is warranted so that also with high running speed of the carrying component and consequently with high performance of a labeling machine an over-stress of the drive arrangement and especially the guide elements is avoided.

To complete this task successfully a pick-up and transfer mechanism as initially describe relating to the invention is desiged so, that with every identical diameter for the rollers or guide rollers the bearing axle of the first roller has a distance from the second axle which is smaller than the distance of bearing axle of the second and third roller to the second axle and that in addition the distance of the bearing axle of the second roller to the second axle is smaller than the distance of the bearing axle of the third roller to this axle.

Trials have shown that an extremely quiet and smooth running is achieved with this configuration of a pick-up and transfer mechanism, and that the intermediate carrier as well as the pick-up element can be pivoted during the circular path of travel of the carrier component in a way which is necessary for a flawless function of the mechanism, without excessively high acceleration or delay within the lever or drive arrangement even when the carrier component runs very fast. These accelerations or delays could lead to high stresses and consequently increased wear.

With a preferred configuration of the invention related pick-up and transfer mechanism the diameter of the rollers or guide rollers is the same as the distance between the first and second axle, whereby preferably the connecting line between the linkage point of the intermediate lever on the lever element and the second axle comprises a first angle with the connecting line between this second axle and the bearing axle of the second roller and a second angle with the connecting line between the second axle and the bearing axle of the third roller, whereby both angles are greater than 90°. The second angle is preferably greater than the first angle, whereby the first angle amounts to about 99° and the second to about 144°.

If the first roller is linked to the lever arm of the intermediate carrier extremely even relations result especially relative to the pivoting motion of the intermediate carrier when the bearing axle for the first roller lies somewhat diametrically opposite the first axle relative to the second axle.

Further configurations of the invention are the subject of secondary claims.

The invention is hereafter more closely explained by means of figures depicting a preferred configuration.

FIG. 1 A partial top view of a pick-up and transfer mechanism in diagram.

Figure 2:
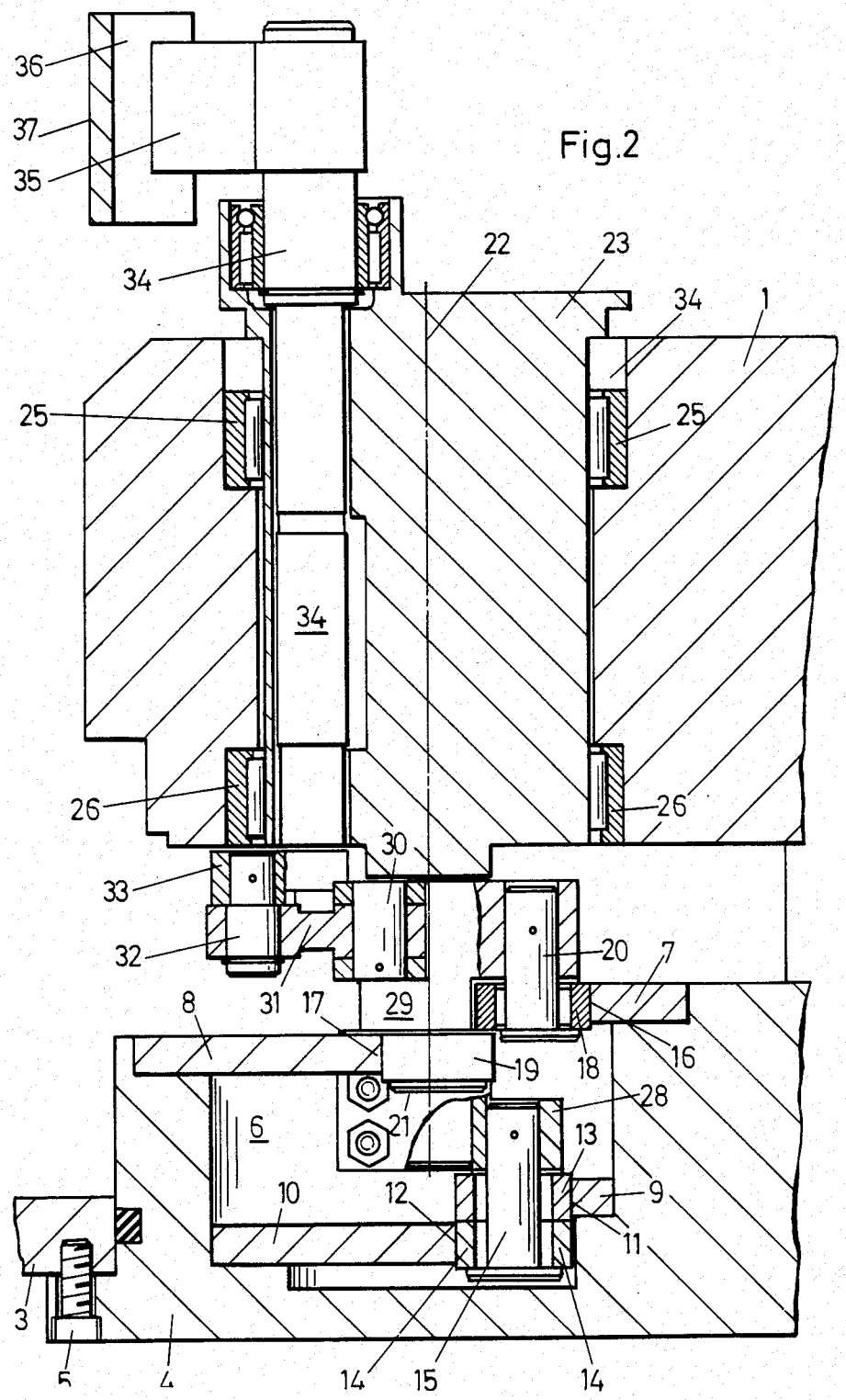

FIG. 2 A partial view in radial section of an actual configuration of the mechanism as per FIG. 1.

The pick-up and transfer mechanism, depicted in the figures, which excells because of the special configuration of its drive or lever arrangement in an extremely quiet and smooth running, consists of a carrier component 1 which is in the form of a plate and mounted so that it can rotate around its center axis, i.e. the vertical axis 2 (the third axle at the upper surface of a machine base and is driven by drive elements not depicted in greater detail).

In FIG. 2 only an upper, horizontally running cover plate 3 of the machine base is depicted, which shows a cut-out in which a plate shaped bearing element 4 is held along its periphery by e.g. several screws 5. The bearing element 4 serves e.g. to the mounting of a shaft not depicted in greater detail, which forms the axle 2 and by means of which the carrier component 1 is driven in rotation.

The bearing element 4 has at its upper side a ring shaped, in upward direction open cut-out 6 in which are set four rocker arm rings 7 through 10 which are connected in a suiting manner, whereby these rocker arm rings form lateral guide surfaces in several planes. Both lower rocker arm rings 9 and 10 which are arranged in different planes, one above the other, form the lateral guide surfaces 11 and 12 which together form the first control cam and each of these works in conjunction with a roller 13 respectively 14. The two rollers 13 and 14, which are rotatable mounted above each other on a common vertical shaft 15 so that they can rotate to form the "first roller" or "first guide" roller of the invention.

Both upper rocker arm rings 7 and 8 also arranged in different horizontal planes form the guide surfaces 16 and 17 which reach into the cut-out 6, of which the guide surface 16 of the rocker arm ring 7 is closer to the axle 2 than the guide surface 17 of the rocker arm ring 8. Against the guide surface 16 lies a roller 18 and against the guide surface 17 a roller 19, whereby the roller 18 forms the second roller and the roller 19 the third roller as in the sense of the invention.

The vertical axles 20 and 21 serve as mounting shafts of the rollers 18 and 19 respectively.

On the carrier component 1 the intermediate carrier 23 is mounted on a vertical axle 22 (the second axle) so that it can rotate or pivot. Corresponding with FIG. 2 this intermediate carrier 23 is of a cylindrical configuration for this purpose and is set in an opening 24 of the carrier component 1 and is held at its periphery by means of needle bearings 25 and 26 so that it can rotate.

To the intermediate carrier 23 a shaft 27 is attached, which protrudes beyond the lower face of the intermediate carrier in FIG. 2 and its axle lies axially even with the axle 22. At the lower end of the shaft 27 a lever arm 28 is mounted so that it can not rotate around the shaft 27. This lever arm 28 stands radially away from this shaft 27 and carries the shaft 15.

Between the lever arm 28 and the intermediate carrier 23 on the shaft 27 a lever element 29 is mounted around the axle 22 so that it can rotate or pivot, whereby this lever element consists of three lever arms 29', 29'' and 29''' which are solidly connected with each other and to this lever element, whereby at the free end of the lever arm 29' the shaft are axle 20 and at the free end of the lever arm 29'' the shaft 21 is connected. The fork shaped lever arm 29''' has its free end a vertical linkage bolt 30, with which the one end of an intermediate lever 31 is linked to the lever arm 29'''. The other end of the intermediate lever 31 is via another vertical linkage bolt 32 linked to a lever arm 33, which stands radially away from the lower end of a shaft 34 and is solidly connected with the lower end of this shaft.

The shaft 34, which has a vertical axis and which forms in the sense of the invention "the first axle" is mounted in the intermediate carrier 23 so that it can rotate or pivot, namely so, that the axis of the shaft 34 is mounted off-set in relation to the axle 22.

The shaft 34 protrudes beyond the upper side of the intermediate carrier 23 and carries on a carrying arm 35, which is connected to the shaft 34 and stands radially away from this shaft, the pick-up element or label pallet 36, which has a circularly curved surface 37 on that side of it which is away from the shaft 34. The curvature radius of this pick-up element or label pallet 36 is about equal to half the diameter of the disc shaped carrier component 1 in the case of the depicted configuration. In each case, the curvature radius of the surface or gripping surface 37 is equal to the radius R of the circular path which is described by the surface 37 when the carrier component 1 rotates around the axle 2, when the label pallet is in its "zero-position" relative to the carrier component 1. "Zero-position" means that position where the carrying arm 35 lies lonitudinally radial to the axis 2, i.e. the imagined elongation of the carrier arm 35 intersects the axis 2.

In order to achieve an extremely smooth and quiet operation of the drive or lever arm arrangement when the carrier component 1 rotates around the axis 2 in the direction of the arrow A, the drive or lever arm arrangement which brings about the pivoting of the intermediate carrier 23 and of the shaft 34 has the hereafter described configuration.

The rollers 13, 14, 18 and 19 have each time the same diameter, i.e. a diameter of 30 units. The shaft 15 for both rollers 13 and 14 is arranged so that the axis of this shaft lies diametrically opposite the axis of the shaft 34 in relation to the axle 22 or to the axis of shaft 27, whereby the axis of the shaft 34 (the first axis) in the sense of the invention shows a distance from the axle 22 (the second axis) in the sense of the invention, which is the same as the diameter of the rollers 13, 14, 18 or 19 and also has 30 units. The axis of the shaft 15 has a distance from the axle 22 or the axis of the shaft 27 which corresonds with 22 units.

The axis of the shaft 20 has a distance from the axle 22 of 28 units and the axis of the shaft 21 a distance of 34 units while the pivoting axis formed by the linkage bolt 30 has a distance from the axle 22 of 50 units.

Furthermore the shafts 20 and 21, on the one hand the linkage bolt 30 on the other hand, are so mounted at the different sides of the axle 22 or the shaft 27 that the connecting line between the axle 22 and the axis of the linkage bolt 30 comprises angle of 99° with the connecting line between the axle 22 and the axis of the shaft 20, and an angle of 144° with the connecting line between the axle 22 and the axis of the shaft 21.

Furthermore the arrangement is made so, that with the circular motion of the carrier component 1 the lever arm 29''' of the lever element 29 goes ahead of the lever arms 29' and 29'', whereby the lever arm 29''' lies within a circle or a circular path of motion with a radius r when the label pallet 36 is in the "zero-position". The axle 22 describes this path of motion. The intermediate lever 31 or the connecting line between the axis of the linkage bolt 30 and the axis of the linkage bolt 32 has a length of 33 units while the length of the lever arm 33 i.e. the distance between the axis of the linkage bolt 32 and the axis of the shaft 34 has 16 units. The surface 37 has a distance from the axis of the shaft 34 which consists of 59 units, whereby the connecting line between the axis of the linkage bolt 32 and the axis of the shaft 34 comprises an angle of 89° with the longitudinally extending line of the carrying arm 35. When the label pallet 36 is in the "zero-position" the linkage bolt 32 and the shaft 34 lie outside the circle or circular path of motion with the radius r.

In the depicted configuration the radius R has 216 and the radius r 143 units, whereby one unit is e.g. one millimeter.

When the carrier component 1 rotates around the axle 2 in the direction of the arrow A, the intermediate carrier 23 is pivoted around the axle 22 by means of the rollers 13 and 14, whereby an additional pivoting of the shaft 34 and of the label pallet 36 is performed around the axis of shaft 34 by means of the rollers 18 and 19 on the lever element 29.

I claim:

1. A pick-up and transfer mechanism for labels or the like, comprising, an intermediate carrier, at least one pick-up element mounted on the carrier for pivotal movement about a first axis, a carrying element, the intermediate carrier being mounted on the carrying element for rotation about a second axis which is offset relative to the first axis, frame means, said carrying element being mounted on the frame means for rotation about a third axis offset from said first and second axes, at least one first guiding means mounted on the intermediate carrier, first control cam means disposed on the frame means and engaged by the one first guiding means whereby said intermediate carrier will be rotated about said second axis in a predetermined manner as said carrying element rotates to move the one first guiding means on the first control cam means, a lever means pivotally mounted on the intermediate carrier and about the second axis, at least one second guiding means disposed on the lever means, a second control cam means disposed on the frame means and engageable by the second guiding means, linkage means for coupling the lever means to the pick-up element whereby the pick-up element will be pivoted in a predetermined manner as said carrying element is rotated to move the first and second guiding means on said first and second control cam means, respectively.

2. The pick-up and transfer mechanism set forth in claim 1 wherein the first guiding means comprises a first roller and the second guiding means comprises second and third rollers, said first, second and third rollers being rotatably mounted respectively about fourth, fifth and sixth axes, the distance between the second and fourth axes being less than the distance between the second and fifth axes and the distance between the second and fifth axes being less than the distance between second and sixth axes, said rollers having substantially equal diameters.

3. The pick-up and transfer mechanism set forth in claim 2 wherein said first control cam means comprises a cam surface and the second control cam means comprises second and third cam surfaces, the second roller engaging the second cam surface and said third roller engaging the third cam surface, said second cam surface being closer to the third axis than said third cam surface.

4. The pick-up and transfer mechanism as set forth in claim 3 wherein the diameter of the rollers are equal to the distance between the first and second axes.

5. The pick-up and transfer mechanism as set forth in claims 3 or 4 wherein the first and fourth axes are on diametrically opposite sides of said second axis.

6. The pick-up and transfer mechanism as set forth in claim 3 wherein said linkage means includes a lever arm mounted on the pick-up element and an intermediate lever coupled at one end to the lever means at a first linkage point and at its other end to the lever arm at a second linkage point.

7. The pick-up and transfer mechanism as set forth in claim 6 wherein a line extending between the second axis and the first linkage point defines a first angle with a line extending between the second axis and the fifth axis and a second angle with a line extending between the second axis and the sixth axis wherein both angles are greater than 90°.

8. The pick-up and transfer mechanism set forth in claim 7 wherein the first angle is smaller than the second angle.

9. The pick-up and transfer mechanism set forth in claim 8 wherein the first angle is 99° and the second angle is 144°.

10. The pick-up and transfer mechanism set forth in claims 3 or 8 wherein the diameter of the rollers is thirty units and the distance between the second and fourth axes equals twenty-two units.

11. The pick-up and transfer mechanism as set forth in claims 3 or 8 wherein the diameter of the rollers is thirty units and the distance between the second and fifth axes equals twenty-eight units and the distance between the second and sixth axes equals thirty-two units and the distance between the second axis and the first linkage point equals fifty units.

12. The pick-up and transfer mechanism as set forth in claims 6 or 8 wherein the intermediate lever has a length of thirty-three units.

13. The pick-up and transfer mechanism as set forth in claims 6 or 8 wherein the length of the lever arm of the pick-up element has a length of sixteen units.

14. The pick-up and transfer mechanism as set forth in claims 6 or 8 wherein the pick up element has a gripping surface, said gripping surface being a distance of fifty-nine units from the first axis.

15. The pick-up and transfer mechanism as set forth in claim 16 wherein a line perpendicular to the gripping surface and intersecting the first axis defines an angle of eighty-nine degrees with a line extending between the first axis and the second linkage point.

16. The pick-up and transfer mechanism as set forth in claim 6 wherein the pick-up element has a circularly curved gripping surface and wherein in one position of the intermediate carrier and the pick-up element, the gripping surface of the pick-up element lies in a circle concentric with the third axis, the one end of the intermediate lever being within a circular path defined by the movement of the second axis when the carrying element rotates about the third axis and the other end of the intermediate lever lying on the outside of the circular path.

17. The pick-up and transfer mechanism set forth in claim 4 and including a lever arm mounted on the pick-up element, and an intermediate lever connected at one end to the lever means at a first linkage point and at its other end to the lever arm at a second linkage point.

18. The pick-up and transfer mechanism set forth in claim 17 wherein a line extending between the second axis and the first linkage point defines a first angle with a line extending between the second and fifth axes and a second angle with a line extending between the second and sixth axes with both of said angles being greater than 90°.

19. The pick-up and transfer mechanism as set forth in claim 18 wherein the diameter of all rollers are equal to thirty units, the distance between the second and fourth axes being equal to twenty-two units, the distance between the second and fifth axes being twenty-eight units, the distance between the second and sixth axes being thirty-two units, the distance between the second axis and the first linkage point being fifty units, the intermediate lever having a length of thirty-three units and the length of the lever arm being sixteen units, said pick-up element having a gripping surface lying a distance of fifty-nine units from the first axis, with a line perpendicular to the gripping surface and intersecting the first axis defining an angle of eighty-nine degrees with a connecting line between the first axis and the second linkage point.

* * * * *